US005543216A

United States Patent [19]

Shiomi et al.

[11] Patent Number: 5,543,216

[45] Date of Patent: Aug. 6, 1996

[54] ACRYLIC COMPOSITE FIBER

[75] Inventors: Yozo Shiomi; Mituru Wakitani, both of Okayama, Japan

[73] Assignee: Japan Exlan Company Limited, Osaka, Japan

[21] Appl. No.: 374,853

[22] Filed: Jan. 19, 1995

[30] Foreign Application Priority Data

Jan. 27, 1994 [JP] Japan ..... 6-026036

[51] Int. Cl.[6] ..... D02G 3/00

[52] U.S. Cl. ..... 428/373; 428/374; 428/394

[58] Field of Search ..... 428/373, 374

[56] References Cited

U.S. PATENT DOCUMENTS

| | | | |
|---|---|---|---|
| 3,693,204 | 1/1972 | Ohki et al. | 428/374 |
| 3,719,738 | 3/1973 | Fujii | 264/171 |
| 3,802,177 | 4/1974 | Sekiguchi et al. | 57/140 |
| 3,864,447 | 2/1975 | Sekiguchi et al. | 264/168 |
| 3,868,816 | 3/1975 | Saji et a. | 428/362 |
| 3,895,165 | 7/1975 | Lohwasser et al. | 428/374 |
| 4,297,412 | 10/1981 | Achard et al. | 428/374 |
| 4,347,203 | 8/1982 | Mimura et al. | 428/374 |
| 4,377,648 | 3/1983 | Menault et al. | 428/374 |
| 5,232,647 | 8/1993 | Sampanis et al. | 264/168 |
| 5,252,396 | 10/1992 | Fukui et al. | 428/374 |

FOREIGN PATENT DOCUMENTS

| | | | |
|---|---|---|---|
| 57-128219 | 8/1982 | Japan . | |
| 192717 | 11/1984 | Japan | 428/374 |

*Primary Examiner*—Patrick Ryan
*Assistant Examiner*—J. M. Gray
*Attorney, Agent, or Firm*—Wenderoth, Lind & Ponack

[57] ABSTRACT

Provided is a wool-like acrylic composite fiber having excellent crimp developability, dyeability and processability, which is characterized in that the difference in the amount of sulfonate groups in the higher and lower heat shrinkable fiber components constituting the fiber is defined to fall within a particular range, that the amount of sulfonate groups in the higher heat shrinkable fiber component is periodically varied within a particular range in the axial direction of the fiber, and that the product of the difference in the amount of sulfonate groups between the higher and lower heat shrinkable fiber components and the ratio of the maximum content of sulfonate groups in the higher heat shrinkable fiber component to the minimum content of the same is defined to fall within a particular range. The composite fiber has a natural hand near to that of natural wool and, when commercially dyed, it has much reduced dyeing specks. The invention can freely design various composite fibers each having a different hand in accordance with the use and the object of fibrous products to be made of such fibers.

1 Claim, No Drawings

ACRYLIC COMPOSITE FIBER

FIELD OF THE INVENTION

The present invention relates to an improved wool-like acrylonitrile composite fiber having excellent crimp developability and excellent dyeability and processability and characterized in that its crimps developed are varied in the axial direction of the fiber.

BACKGROUND OF THE INVENTION

Heretofore, acrylonitrile composite fibers have been produced industrially as fibrous materials for clothes, carpets, etc., as having excellent crimp characteristics, high bulkiness, excellent dyeability, etc. As one example of producing them, there is known a method for producing side-by-side acrylonitrile composite fibers comprising composite components bonded together in a side by side relationship, in which a spinning dope comprising at least two acrylonitrile copolymers dissolved therein and differing in the content of sulfonate groups (water reversible components), as the components for forming the composite fiber, is let to a spinnerette for bicomponent spinning and spun therethrough (for example, Japanese Patent Publication No. 35288/82).

The water reversibility as referred to herein means such a property of reversible elongation due to swelling with water and shrinkage due to drying.

However, since the water reversible components are arranged in a laminar state throughout the fiber length in such a prior art, the crimps of the fiber are formed uniformly, being different from those of fibers of natural wool which are naturally varied in the axial direction of the fiber. Therefore, the hand of conventional acrylonitrile composite fibers is hard, being different from that of fibers of natural wool. The dyeing speed of acrylonitrile fibers having water reversible crimpability is accelerated with the enlargement of the water reversibility because of their sulfonate groups, with the result that they are often dyed unevenly to have dyeing specks in commercial dyeing in which, therefore, fibrous products made of the fibers cannot be dyed satisfactorily although conventional acrylonitrile fibers are generally dyed well.

We, the present inventors repeated our studies so as to overcome the above-mentioned drawbacks in the prior art and, as a result, have achieved the present invention.

SUMMARY OF THE INVENTION

Specifically, the object of the present invention is to provide an acrylonitrile composite fiber which has crimp developability varying in the axial direction of the fiber and therefore has voluminousness and a natural hand near to that of fibers of natural wool and which has been improved to have reduced dyeing specks in commercial dyeing.

The object of the present invention has been attained by an improved acrylic composite fiber consisting of a higher heat shrinkable acrylonitrile copolymer fiber component (hereinafter referred to as ANA, as the case may be) made of acrylonitrile and comohomer (hereinafter referred to as comonomer ) copolymerizable therewith and a lower heat shrinkable acrylonitrile copolymer fiber component (hereinafter referred to as ANB, as the case may be) made of acrylonitrile and comonomer (hereinafter referred to as comonomer b) copolymerizable therewith, said higher heat shrinkable fiber component and lower heat shrinkable fiber component being bonded together in a side by side relationship in the axial direction of the fiber, and the difference in the amount between comonomers a and b being from 1 to 10% by weight, which is characterized in that the amount of sulfonate groups in said composite fiber is from 0.2 to 1.0% by weight, that the amount of sulfonate groups in the higher heat shrinkable fiber component having a larger amount of comonomers copolymerized is larger by from 0.2 to 1.0% by weight than the amount of sulfonate groups in the lower heat shrinkable fiber component, and that the amount of sulfonate groups in the higher heat shrinkable fiber component is varied with a periodic cycle of from 50 to mm along the axial direction of the fiber, while satisfying the range defined by the following formulae (1) and (2):

$$1.2 \leqq (Amax/Amin) \leqq 3 \quad (1)$$

wherein Amax and Amin respectively represent the maximum value and the minimum value of the amount (% by weight) of sulfonate groups, in the axial direction of the fiber, in the higher heat shrinkable acrylonitrile copolymer fiber component.

$$0.24 \leqq (A-B) \times (Ammax/Amin) \leqq 2.5 \quad (2)$$

wherein A and B respectively represent the amount (% by weight) of sulfonate groups on average, in the axial direction of the fiber, in the higher and lower heat shrinkable acrylonitrile copolymer fiber component.

DETAILED DESCRIPTION OF THE INVENTION

The present invention will be described in detail hereunder. It is premised that the difference in the amount between the comonomer a and the comonomer b in the two acrylonitrile copolymer components ANA and ANB, respectively, both constituting the acrylonitrile composite fiber of the present invention is from 1 to 10% by weight. This is because, if the difference in the copolymerizing ratio of the comonomers in these two components is less than 1% by weight, the crimp developability of the fiber due to the difference in the thermal shrinkage is low so that the intended composite fiber cannot be obtained. When the difference in the amount of sulfonate groups on average in these two components is made large in order to elevate the crimp developability of the fiber, then the amount of sulfonate groups to be the dyeing sites in the composite fiber is thereby enlarged to accelerate the dyeing speed of the fiber with the result that the fiber cannot be dyed satisfactorily although conventional acrylonitrile fibers are generally dyed well. On the other hand, if the difference in the copolymerizing ratio of the comonomers in these two components is more than 10% by weight, the heat sensitivity of the fiber is too large or, that is, the fiber is too much crimped due to the difference in the thermal shrinkage based on the difference in the acrylonitrile content between the two acrylonitrile copolymer components. If so, it is impossible even by the technique of the present invention to obtain the intended acrylonitrile composite fiber having a natural hand near to that of fibers of natural wool.

The acrylonitrile copolymer for use in the present invention can be obtained by aqueous suspension polymerization or the like which is well known to be employable for acrylonitrile polymerization. As examples of comonomer copolymerizable with acrylonitrile, mentioned are methyl acrylate, vinyl acetate, methacrylic acid, etc.

These higher and lower heat shrinkable acrylonitrile copolymer fiber components are bonded together in in a side by side relationship to give the composite fiber of the present invention. The amounts of these copolymers are such that the amount of the higher heat shrinkable acrylonitrile copolymer fiber component is from 20 to 80% by weight and that of the lower heat shrinkable acrylonitrile copolymer fiber component is from 20 to 80% by weight.

If the amount of sulfonate groups to be the dyeing sites in the composite fiber of the present invention is enlarged too much, the dyeing speed of the fiber is accelerated too high so that the composite fiber cannot have good dyeability, as so mentioned hereinabove. For this reason, the amount of sulfonate groups in the composite fiber must be from 0.2 to 1.0% by weight. This range shall apply to both the higher and lower heat shrinkable acrylonitrile copolymer fiber components. If the amount of sulfonate groups in question is less than 0.2% by weight, the acrylonitrile composite fiber cannot have good dyeability. If, on the other hand, it is more than 1.0% by weight, the dyeing speed of the fiber is accelerated too high for the same reason as that mentioned hereinabove, resulting in dyeing specks, etc. which noticeably detract from the quality of the acrylonitrile fiber. If so, the object of the present invention cannot be attained.

The higher heat shrinkable fiber component (ANA) as referred to herein means an acrylonitrile copolymer fiber component having a larger content of comonomer In addition, the amount of sulfonate groups in said higher heat shrinkable fiber component (ANA) is larger than that of sulfonate groups in the other lower heat shrinkable fiber component (ANB) while the difference between the two amounts must be from 0.2 to 1.0% by weight. This because, if the difference in the amount of sulfonate groups on average, in the axial direction of the composite fiber of the present invention, between the higher heat shrinkable fiber component and the lower heat shrinkable fiber component is more than 1.0% by weight, the dyeing speed of the fiber is too high, resulting in dyeing specks in commercial dyeing of the fiber, and such dyeing specks noticeably detract from the quality of the acrylonitrile fiber. On the other hand, if said difference is less than 0.2% by weight, the water reversible crimpability of the fiber or, that is, the crimp developability thereof based on its water reversibility is lowered with the result that fibrous products having a voluminous hand cannot be produced from the fiber. After such fibers have once lost their voluminousness, it is extremely difficult to restore them. Therefore, such composite fibers having such problems have no value as commercial products.

The amount of sulfonate groups on average in the axial direction of the fiber as referred to herein means the average of the amounts of sulfonate groups in the two fiber components, one being the higher heat shrinkable fiber component and the other being the lower heat shrinkable fiber component. In the former higher heat shrinkable fiber component, the amount of sulfonate groups shall be the sum of sulfonate groups in the acrylonitrile copolymer and sulfonate groups from a polymer substance to be added to the component later on.

The most characteristic aspect of the acrylonitrile composite fiber of the present invention is that the amount of sulfonate groups in the higher heat shrinkable fiber component constituting the fiber is varied with a periodic cycle of from 50 to 600 mm along the axial direction of the fiber, while satisfying the range defined by Formulae (1) and (2).

Since the amount of sulfonate groups in the higher heat shrinkable fiber component is varied along the axial direction of the fiber, the parts of the fiber having a higher content of sulfonate groups have high crimpability, while making the entire composite fiber bulky and voluminous because of the same effect as that to be attained when a small amount of high shrinkable fibers are added to bulky yarns. Therefore, as compared with a composite fiber containing therein the same amount of sulfonate groups on average that have been uniformly arranged in laminar state, the composite fiber of the present invention can be formed into fibrous products having higher bulkiness and higher voluminousness.

Accordingly, to obtain fibrous products having bulkiness and voluminousness on the same level from these fibers, the composite fiber of the present invention may contain a smaller amount of sulfonate groups on average than the composite fiber containing therein sulfonate groups that have been uniformly arranged in laminar state. Therefore, the defect of dyeing specks is relieved in commercial dyeing of fibrous products made of the composite fiber of the present invention. On the other hand, it is considered that the soft and voluminous hand of natural wool is considered because of the gentle distribution of the crimps in the axial direction of the fibers constituting it. According to the present invention, such a soft and voluminous hand of the composite fiber of the invention has been realized by the means mentioned below.

First, the object of the present invention has been attained by varying the amount of sulfonate groups in the higher heat shrinkable fiber component constituting the composite fiber of the invention in the axial direction of the fiber while satisfying the range defined by Formulae (1) and (2). In addition, the characteristic aspect of the composite fiber to be provided by the present invention is that various composite fibers each having a different hand can be freely designed in accordance with the use and the object of fibrous products made of them by appropriately controlling the degree of the variation in this amount.

However, if the product of the ratio (Amax./Amin.) of the maximum value (Amax.) of the amount of sulfonate groups in the higher shrinkable fiber component in the axial direction of the fiber to the minimum value (Amin.) of the same and the difference (A–B) in the amount of sulfonate groups on average between the higher and lower heat shrinkable fiber components is less than 0.24% by weight, the dry crimp developability of the fiber is low. If so, therefore, the composite fiber cannot be voluminous as its water reversibility is low. If, however, the product is more than 2.5% by weight, the fiber is too much crimped, resulting in having an extremely hard hand, and, in addition, the dyeing speed of the fiber is extremely high. If so, therefore, the fiber cannot be dyed uniformly, resulting in noticeably detracting from the quality of the acrylonitrile fiber.

According to the present invention, the amount of sulfonate groups in the higher shrinkable fiber component must be varied with a periodic cycle of from 50 to 600 mm, preferably from 50 to 400 mm, along the axial direction of the fiber. If the periodic cycle is lower than the lowermost limit, the industrial producibility of such fibers is extremely poor. Therefore, such is not employable. On the other hand, if the periodic cycle is higher than the uppermost limit, the difference between the fiber and a composite fiber containing therein sulfonate groups arranged in laminar state is small, resulting in the decrease in the above-mentioned effect of the present invention.

Where the acrylonitrile composite fiber of the present invention in which the amount of sulfonate groups on average in the higher heat shrinkable fiber component constituting the fiber is varied along the axial direction of the fiber is produced by wet spinning in the presence of an inorganic solvent, two acrylic polymers having different heat shrinkability, which are produced by generally well-known aqueous suspension polymerization, are separately dissolved to prepare spinning dopes. (The spinning dope comprising the higher heat shrinkable acrylic polymer is referred to as Ad; and the spinning dope comprising the lower heat shrinkable acrylic polymer is as Bd.)

Next, a polymer substance that has been prepared separately by copolymerizing monomers having sulfonate group is added to Ad while changing with time the amount thereof to be added by changing the rotation number of the measuring pump in the way of the pipe line for feeding the spinning dope. Then, while these are continuously mixed and dissolved, the resulting blend is led to a spinnerette for bicomponent spinning, along with the other component Bd, and extruded into a coagulation bath. Then, this is washed with water, stretched, dried for collapsing, wet-treated under heat, treated with an oil agent, treated for crimp formation, etc. After this process, a final fiber is formed. To change with time the amount to be added, employable are a continuously changing method and a stepwise changing method.

As examples of the monomers having sulfonate groups for acrylonitrile polymers to be used in Ad and Bd or as the polymer substance, mentioned are sodium methallylsulfonate, sodium styrene-parasulfonate, sodium vinylsulfonate, sodium allylamidomethylpropane-sulfonate, and the corresponding potassium salts. The amount of sulfonate group as referred to herein is in terms of the amount of the corresponding sulfonic acid.

As one example of the polymer substance to be prepared by copolymerizing monomers having sulfonate group, mentioned is a latex comprising acrylonitrile/methyl acrylate/sodium styrene-parasulfonate monomers, Which is obtained by copolymerizing these monomers by ordinary aqueous continuous polymerization using a redox catalyst comprising ammonium persulfite/sodium pyrosulfite. However, this is not limitative.

Next, the present invention will be described more concretely by means of the following examples, in which the water reversibility, the crimp characteristic, the dyeing rate and the other characteristics of the fibers obtained are measured by the methods mentioned below.

(1) Percentage of water reversibility (%):

This is calculated by the following formula:

$$[(L_W-L_D)/(L_1-L_D)]\times 100$$

wherein $L_1$ represents the original length of the ply of the gray fibers corresponding to about 300 d, as measured under a weight of 11 mg/d applied thereto;

$L_w$ represents the length of the same ply sample, as measured in such a way that it is first boiled in water, while being kept free therein, for 15 minutes and then cooled at 20° C. or lower, and, after water is removed therefrom with a filter paper, a weight of 11 mg/d is applied thereto; LB represents the length of the same ply sample, as measured in such a way that the wet sample mentioned above is then dried at 80° C. for 30 minutes, while being kept free, and cooled to room temperature, and a weight of 11 mg/d is applied thereto.

(2) Crimp characteristic: (n=50), JIS L1015

Cn: number of crimps (/25 mm) coefficient of variation (%)=(standard deviation/average value)×100

Ci: percentage of crimps (%) coefficient of variation (%)=(standard deviation/average value)×100

(3) Dyeing speed (dyeing rate):

dye bath (master solution): 3.5% of dye (Sumiacryl Orange 3R), 3.0% of acetic acid liquor ratio: 1/100 temperature, time: 93° C.×60 min.

measurement: colorimetric method for the residual dye solution after dyeing, using a spectrophotometer (470 mμ)

$$\text{Dyeing Rate} = \{[(\text{absorbency of the master solution}) - (\text{absorbency of the residual dye solution after dyeing})]/(\text{absorbency of the master solution})\} \times 100$$

(4) Bulkiness of knit fabric:

sample: 5G×2P Sheeting knit fabric×4 layers weight, measurement: The thickness (mm) of the knit fabric was measured under a load of 0.1 g/cm$^2$ applied thereto.

(5) Compressibility:

machine used: Tensilon RTA-500 compression speed: 20 mm/min compression area: 70 mm$^2$ sample: 5G×2P sheeting knit fabric×4 layers measurement: The thickness (mm) of the sample under a load of 0.1 g/cm$^2$ is referred to as L1. The thickness (mm) of the sample under a load of 10 g/cm$^2$ is referred to as L2. Compressibility (%) =[(L1−L2)/L1]×100

In the following tables, the marks ○, Δ and × indicate the results of the evaluation of the tested items, each having the following meanings:

For level dyability;

○: The sample tested can be dyed satisfactorily in commercial dyeing.

Δ: The sample tested is dyed somewhat unevenly to have dyeing specks in commercial dyeing, but this can be put to practical use, if limited.

×: The sample tested is dyed unevenly to have dyeing specks, which noticeably detract from the outward appearance and the quality of the dyed sample.

For handling of knit fabric;

○: The sample satisfies the object of the present invention, as having a good hand similar to that of natural wool.

Δ: The sample has somewhat poor voluminousness, and its handling is somewhat harsh to the touch.

×: The sample has poor voluminousness, and its handling is harsh to the touch.

EXAMPLE 1

As the higher heat shrinkable fiber component (Ap component) of the composite fiber to be prepared herein, used was a copolymer comprising 88% by weight of acrylonitrile, 11.7% by weight of vinyl acetate, as the second component and 0.3% by weight of sulfonate group and having [η] of 1.5. As the lower heat shrinkable fiber component (Bp component) of the same, used was a copolymer comprising 90% by weight of acrylonitrile, 9.7% by weight of methyl acrylate and 0.3% by weight of sulfonate group and having [η] of 1.5.

The two copolymers, Ap and Bp were separately dissolved in an aqueous solution of 48% sodium rhodanate to prepare spinning dopes (Ad, Bd) having a copolymer content of 11% by weight.

50% by weight of acrylonitrile, 30% by weight of methyl acrylate and 20% by weight of a sulfonate group-containing monomer, sodium styrene-parasulfonate were polymerized by continuous polymerization using a redox catalyst comprising ammonium persulfite/sodium pyrosulfite, to prepare a semi-permeable latex (C) containing 7.5% by weight of sulfonate groups and having a dry solid content of 19% by weight.

The spinning dope of Bp component (Bd) was fed, directly as it was, into a bicomponent spinning device, such as that described in Japanese Patent Publication No. 24301/64, in such a way that the ratio of Ap/Bp might be 1/1. On the other hand, the spinning dope of Ap component (Ad) was fed into an in-line mixer in which the dope fed thereinto could be stirred at a high stirring rate, said mixer having been combined with the pipe line of the device for feeding spinning dopes thereinto, while latex (C) that had been prepared separately was also fed into said in-line mixer, added to, mixed with and dissolved in dope (Ad) therein in such a way that the proportions of sulfonate groups in the resulting blend might be those shown in Table 1 below. Thus, mixed spinning dope (Al) was formed continuously, which was then led into the bicomponent spinning device. To lead latex (C) to the inline mixer, used was a gear pump having excellent measurability.

Next, these Al and Bd dopes thus introduced into the bicomponent spinning device were wet-spun into an aqueous solution of 10% sodium rhodanate at 0° C., and the resulting wet filament was stretched 10 times in boiling water and then dried in hot air at 115° C. The thus obtained fiber was then heat-treated in pressure steam at 113C to form a composite fiber of 5 d. The thus-obtained composite fiber was thereafter spun by an ordinary method to form a spun yarn with a metric count to 2/20's, which was then dyed by hank dyeing. The thus-dyed yarns were knitted into a sheeting knit fabric of 5 gauge×2 ply. The characteristics of the gray composite fibers and the knit fabrics thus obtained are shown in Table 1 below.

TABLE 1

| Sample No. | 1 | 2 | 3 | 4 | 5 |
|---|---|---|---|---|---|
| Amount of sulfonate groups (%) | | | | | |
| A component | 0.4 | 0.6 | 0.9 | 1.3 | 0.9 |
| B component | 0.3 | 0.3 | 0.3 | 0.3 | 0.3 |
| ① A − B | 0.1 | 0.3 | 0.6 | 1.0 | 0.6 |
| ② Ratio of Amax./Amin. | 1 | 2 | 2 | 2 | 1 |
| ① × ② | 0.1 | 0.6 | 1.2 | 2.0 | 0.6 |
| Periodic cycle (mm) of Amax.~Amin. | ∞ | 200 | 200 | 200 | ∞ |
| Water reversibility (%) | 5 | 26 | 41 | 72 | 38 |
| Crimps after boiling, Cn (number of crimps) | 19 | 21 | 24 | 32 | 28 |
| Coefficient of variation in Cn (%) | 9 | 12 | 13 | 15 | 10 |
| Crimps after boiling, Ci (%) | 28 | 35 | 36 | 40 | 36 |
| Coefficient of variation in Ci (%) | 11 | 25 | 31 | 41 | 13 |
| Dyeing rate (%) | 53 | 65 | 77 | 93 | 77 |
| Uniform dyeability by dip dyeing | ○ | ○ | ○ | Δ | ○ |
| Hand of knit fabric voluminousness/softness | X/X | Δ/o | o/o | o/o | Δ/X |
| Bulkiness (mm) | 12 | 17 | 19 | 24 | 17 |
| Compressibility | 48 | 56 | 58 | 56 | 46 |

From the results in Table 1 above, it is known that samples Nos. 1 and 5 having a periodic cycle of Amax. ~ Amin of ∞ (these samples are conventional composite fibers having therein sulfonate groups uniformly arranged in laminar state) have low bulkiness or low compressability and therefore have poor voluminousness and softness, while samples Nos. 2 to 4 of the present invention all have a larger coefficient of variation in crimps and therefore have larger bulkiness and compressability to have a soft and voluminous hand similar to that of natural wool than the conventional composite fibers having therein sulfonate groups uniformly arranged in laminar state.

EXAMPLE 2

Composite fibers of 5d were formed in the same manner as in Example 1, while varying the mixing ratio of the copolymer dopes and the latex to the range shown in Table 2 below. The characteristics of the gray composite fibers and the knit fabrics obtained are shown in Table 2.

TABLE 2

| Sample No. | 6 | 7 | 8 | 9 | 10 | 11 |
|---|---|---|---|---|---|---|
| Amount of sulfonate groups (%) | | | | | | |
| A component | 0.6 | 0.6 | 0.9 | 1.2 | 1.0 | 1.2 |
| B component | 0.3 | 0.3 | 0.3 | 0.3 | 0.3 | 0.3 |
| ① A − B | 0.3 | 0.3 | 0.6 | 0.9 | 0.7 | 0.9 |
| ② Ratio of Amax./Amin. | 1.0 | 1.2 | 1.5 | 2.0 | 3.0 | 3.0 |
| ① × ② | 0.3 | 0.36 | 0.9 | 1.8 | 2.5 | 2.7 |
| Periodic cycle (mm) of Amax.~Amin. | ∞ | 200 | 200 | 200 | 200 | 200 |
| Water reversibility (%) | 22 | 24 | 38 | 66 | 41 | 69 |
| Crimps after boiling, Cn (number of crimps) | 20 | 20 | 23 | 30 | 25 | 32 |
| Coefficient of variation in Cn (%) | 10 | 10 | 12 | 14 | 16 | 16 |
| Crimps after boiling, Ci (%) 33 | 33 | 34 | 35 | 40 | 37 | 40 |
| Coefficient of variation in Ci (%) | 12 | 17 | 26 | 37 | 43 | 46 |
| Dyeing rate (%) | 65 | 65 | 77 | 88 | 81 | 88 |
| Uniform dyeability by dip dyeing | ○ | ○ | ○ | Δ | | × |
| Hand of knit fabric voluminousness/softness | ×/× | Δ/Δ | o/o | o/o | o/o | o/o |
| Bulkiness (mm) | 13 | 14 | 18 | 23 | 21 | 23 |
| Compressibility (%) | 46 | 50 | 55 | 56 | 56 | 57 |

From the results shown in Table 2 above, it is known that the knit fabric of sample No. 6 having a periodic cycle of Amax. ~ Amin. of being ∞ has low bulkiness or low compressability and therefore has poor voluminousness and softness and that the knit fabric of sample No. 11 having a value of ①×② of being more than 2.5 is uneven and has extremely bad appearance and quality to be unacceptable as a fibrous product for commercial sale, whilst samples Nos. 7 to 10 have obviously excellent voluminousness, softness and dyeability.

EXAMPLE 3

Composite fibers of 5d were formed in the same manner as in Example 1, while varying the mixing ratio of the copolymer dopes and the latex to the range shown in Table 3 below. The characteristics of the gray composite fibers and the knit fabrics obtained are shown in Table 2.

TABLE 3

| Sample No. | 12 | 3 | 13 | 14 | 15 |
|---|---|---|---|---|---|
| Amount of sulfonate groups (%) | | | | | |
| A component | 0.9 | 0.9 | 0.9 | 0.9 | 0.9 |
| B component | 0.3 | 0.3 | 0.3 | 0.3 | 0.3 |

TABLE 3-continued

| Sample No. | 12 | 3 | 13 | 14 | 15 |
|---|---|---|---|---|---|
| ① A − B | 0.6 | 0.6 | 0.6 | 0.6 | 0.6 |
| ② Ratio ofAmax./Amin. | 2 | 2 | 2 | 2 | 2 |
| ① × ② | 1.2 | 1.2 | 1.2 | 1.2 | 1.2 |
| Periodic cycle (mm) of Amax.~ Amin. | 100 | 200 | 400 | 500 | 700 |
| Water reversibility (%) | 42 | 41 | 40 | 39 | 38 |
| Crimps after boiling, Cn (number of crimps) | 25 | 24 | 23 | 23 | 27 |
| Coefficient of variation in Cn (%) | 13 | 13 | 12 | 12 | 10 |
| Crimps after boiling, Ci (%) 33 | 37 | 36 | 35 | 35 | 36 |
| Coefficient of variation in Ci (%) | 33 | 31 | 28 | 25 | 17 |
| Dyeing rate (%) | 77 | 77 | 77 | 77 | 77 |
| Uniform dyeability by dip dyeing | ○ | ○ | ○ | ○ | ○ |
| Hand of knit fabric voluminousness/softness | ○/○ 16 | ○/○ | ○/○ | ○/○ | Δ/× |
| Bulkiness (mm) | 20 | 19 | 18 | 18 | 16 |
| Compressibility (%) | 60 | 58 | 57 | 54 | 47 |

From the results shown in Table 3 above, it is known that the coefficient of variation in crimps becomes smaller with the increase in the periodic cycle of Amax. ~ Amin., resulting in worsening the voluminousness and the softness of the samples. Sample No. 15 having a periodic cycle of 700 mm cannot have the intended natural wool-like hand. On the other hand, if the producibility is ignored, a sample having a periodic cycle of 40 mm can be formed but this is unacceptable as a commercial product in view of the industrial cost performance.

According to the-present invention, the difference in the amount of sulfonate groups between the higher and lower heat shrinkable fiber components constituting the composite fiber of the invention is defined to fall within a particular range while the amount of sulfonate groups in the higher heat shrinkable fiber component is varied with a periodic cycle falling within a particular range, along the axial direction of the fiber, by which the fiber is made to have a gentle variation in crimps in the axial direction of the fiber. Accordingly, the composite fiber thus provided by the present invention can have a natural wool-like hand. However, a conventional composite fiber where the heat shrinkable fiber component or the water reversible component is arranged in uniform laminar state throughout the fiber length, that is produced by the prior art, has a hard hand and cannot have a natural wool-like hand, since the crimps of the fiber are uniform.

Since the amount of sulfonate groups in the higher heat shrinkable fiber component constituting the composite fiber of the present invention is periodically varied within a particular range, along the axial direction of the fiber, the bulkiness and the voluminousness of the entire composite fiber can be improved due to the higher crimpability of the parts of the fiber having a larger amount of sulfonate groups, because of the same effect as that to be attained when a small amount of high shrinkable fibers are added to bulky yarns. Therefore, to obtain fibrous products having bulkiness and voluminousness on the same level from these fibers, the composite fiber of the present invention may contain a smaller amount of sulfonate groups on average than the composite fiber containing therein sulfonate groups that have been uniformly arranged in laminar state, with the result that the defect of dyeing specks is relieved in commercial dyeing of fibrous products made of the composite fiber of the present invention.

In addition, by appropriately controlling the degree of the periodic variation in the amount of sulfonate groups in the higher shrinkable fiber component along the axial direction of the fiber, various composite fibers each having a different hand can be freely designed in accordance with the use and the object of fibrous products made of them. Such is one of remarkable effects of the present invention.

What we claim is:

1. In an acrylic composite fiber consisting of a higher heat shrinkable acrylonitrile copolymer fiber component made of acrylonitrile and comonomer copolymerizable therewith and a lower heat shrinkable acrylonitrile copolymer fiber component made of acrylonitrile and same or different comonomer copolymerizable therewith, said higher heat shrinkable fiber component and lower heat shrinkable fiber component being bonded together in a side by side relationship in the axial direction of the fiber, and the amount of the comonomer in the higher heat shrinkable fiber component being larger by from 1 to 10% by weight than the amount of the comonomer in the lower heat shrinkable fiber component, the improvement wherein the amount of sulfonate groups in said composite fiber is from 0.2 to 1.0% by weight, the amount of sulfonate groups in the higher heat shrinkable fiber component is larger by from 0.2 to 1.0% by weight than the amount of sulfonate groups in the lower heat shrinkable fiber component, and the amount of sulfonate groups in the higher heat shrinkable fiber component is varied from AmaX to Amin and back to Amax over a periodic cycle of from 50 to 600 mm along the axial direction of the fiber, while satisfying the ranges defined by the following formulae (1) and (2):

$$1.2 \leqq (Amax/Amin) \leqq 3 \quad (1)$$

wherein Amax and Amin respectively represent the maximum value and the minimum value of the amount in % by weight of sulfonate groups, over said periodic cycle in the axial direction of the fiber, in the higher heat shrinkable fiber component;

$$0.24 \leqq (A-B) \times (Amax/Amin) \leqq 2.5 \quad (2)$$

wherein A and B respectively represent the amount in % by weight of sulfonate groups on average, in the axial direction of the fiber, in the higher and lower heat shrinkable fiber components.

* * * * *